US006215233B1

(12) United States Patent
Matsubara

(10) Patent No.: US 6,215,233 B1
(45) Date of Patent: Apr. 10, 2001

(54) SPARK PLUG

(75) Inventor: Yoshihiro Matsubara, Mie (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/233,994

(22) Filed: Jan. 19, 1999

(30) Foreign Application Priority Data

Feb. 2, 1998 (JP) ..... 10-036758

(51) Int. Cl.[7] ..... H01T 13/38; H01T 13/32; H01T 13/16

(52) U.S. Cl. ..... 313/118; 313/142; 313/143; 313/11.5

(58) Field of Search ..... 313/11.5, 142, 313/143, 118

(56) References Cited

U.S. PATENT DOCUMENTS 3,800,179 * 3/1974 Louzecky ..... 313/118

5,144,188 * 9/1992 Kagawa et al. ..... 313/142

* cited by examiner

*Primary Examiner*—Vip Patel
*Assistant Examiner*—Ken A Berck
(74) *Attorney, Agent, or Firm*—Brinks Hofer Gilson & Lione

(57) ABSTRACT

In a spark plug, a main gap is formed between the center electrode and the ground electrode, and an auxiliary gap is formed between the center electrode and a projecting inner edge formed at an open end portion of the metallic shell. The inner wall surface of the metallic shell extending from a terraced portion toward the tip end of the metallic shell is tapered such that the diameter of the inner wall surface decreases toward the tip end of the metallic shell by an amount of 0.6 mm or more. Through reduction of a gas volume defined by the insulator and the inner wall surface of the metallic shell, entry of high temperature combustion gas can be reduced to thereby decrease a thermal load imposed on the insulator, while entry of carbon can be minimized to thereby prevent contamination. Accordingly, heat resistance and contamination resistance can be significantly improved, and thus the range of operation of the spark plug can be widened.

6 Claims, 4 Drawing Sheets

SPARK PLUG

BACKGROUND OF THE INVENTION

1. Field of the Invention

The present invention relates to a spark plug having an auxiliary gap in addition to a regular gap defined by a center electrode and a ground electrode in order to effectively suppress flashover which would otherwise propagate from a tip end surface of an insulator of the spark plug toward the interior of the spark plug over the surface of the insulator upon application of high voltage thereto. The present invention effectively suppresses flashover even when used in an engine which is highly likely to suffer smolder, particularly an engine designed such that during a compression stroke fuel is injected in order to form a rich mixture in the vicinity of a spark portion of a spark plug, thereby causing combustion by the spark plug (hereinafter referred to as a "stratified charge combustion engine").

2. Description of the Related Art

Conventionally, a certain spark plug used in an internal combustion engine has not only a main gap defined by a center electrode and a ground electrode—the center electrode being held by an insulator which tapers off toward the tip end thereof and the ground electrode being connected to the tip end of a metallic shell which fixedly supports the insulator—but also an auxiliary gap defined by the center electrode and a projecting inner edge formed at an open end portion of the metallic shell. In such a spark plug, the inner wall surface of the metallic shell—which fixedly supports the insulator and, in turn, holds the center electrode—has substantially the same diameter along the center axis of the center electrode held by the insulator, i.e., is substantially perpendicular to the open end portion of the metallic shell.

In the aforementioned conventional spark plug used in an internal combustion engine, a space (hereinafter may be referred to as a gas volume) defined by the surface of a leg portion of the insulator secured in the metallic shell and the corresponding inner wall surface of the metallic shell mainly extending from a terraced portion toward a tip end of the metallic shell widens toward the tip end. In a combustion chamber of an internal combustion engine, combustion gas generated as a result of ignition of an air-fuel mixture tends to enter the gas volume. Accordingly, during high speed operation, high temperature combustion gas enters the gas volume. As a result, the leg portion of the insulator secured in the metallic shell is subjected to a very severe thermal load, potentially resulting in deterioration in heat resistance of the leg portion.

If, in order to prevent deterioration in heat resistance of the leg portion of the insulator, the gas volume is decreased while the inner wall surface of the metallic shell is maintained at substantially the same diameter along the center axis of the center electrode, a gap between the surface of the insulator and the inner wall surface of the metallic shell becomes significantly narrow at a deep interior portion of the metallic shell; for example, at the terraced portion. Thus, particularly when the engine is not warmed up, such as at start-up, carbon which is generated in association with incomplete combustion of rich mixture enters deep into the metallic shell and adheres to and accumulates on the surface of the insulator. Carbon adhering to and accumulating on the insulator surface causes spark leak, which, when contamination with carbon is significant, may impair startability.

Particularly, in the case of an engine (hereinafter may be referred to as a cylinder-injection-of-fuel engine) in which fuel is directly injected into a combustion chamber, smolder tends to occur with resultant spark leak.

Specifically, a feature of the cylinder-injection-of-fuel engine is employment of a "stratified charge combustion scheme," in which fuel is injected during a compression stroke in order to form a rich mixture in the vicinity of a spark portion of a spark plug, thereby causing combustion by the spark plug. This feature allows leaner overall air/fuel mixtures within the combustion chamber, thereby decreasing fuel consumption. In stratified charge combustion, timing of fuel injection is set to near a predetermined ignition point during the compression stroke so as to initiate combustion through ignition of the rich mixture around a spark plug. Such stratified charge combustion is disclosed in, for example, Japanese Patent Application Laid-Open (kokai) Nos. 41-183922 and 58-178835. According to the disclosed stratified charge combustion, the mixture to be formed around the spark portion of a spark plug is set to a very rich level. Moreover, since combustion temperature does not increase sufficiently, the spark plug suffers smolder due to contamination with carbon.

Meanwhile, even when carbon adheres to the insulator of the spark plug, progress of contamination with the adhering carbon is prevented through burning or blowoff of the carbon effected by spark cleaning action, thereby suppressing reduction in insulating resistance (MΩ) between the center electrode and the metallic shell.

However, in the case of stratified charge combustion as in a cylinder-injection-of-fuel engine, spark cleaning action fails to follow the progress of contamination with carbon; consequently, contamination with carbon progresses. Progressive contamination with carbon causes the insulating resistance (MΩ) to decrease, causing increased tendency toward flashover with resultant poor engine operation (engine stall, poor idling condition, poor drivability and defective startup).

SUMMARY OF THE INVENTION

The present invention has been accomplished in view of the above problems and an object of the invention is to provide a spark plug capable of preventing deterioration in heat resistance, which would otherwise result from entry of high temperature combustion gas, through reduction of gas volume, as well as capable of maintaining a certain distance between the surface of the insulator and the inner wall surface of the metallic shell to thereby improve resistance to contamination with carbon for suppression of spark leak and thus to initiate regular spark discharge within an air-fuel mixture over a wide range of working conditions even when used in an engine which employs stratified charge combustion and thus tends to suffer smolder.

To achieve the above object, the present invention provides a spark plug comprising an insulator tapered such that the diameter of the insulator decreases toward a tip end thereof; a center electrode held by the insulator; a metallic shell which fixedly supports the insulator such that a tip end portion of the insulator projects therefrom and such that the insulator abuts a terraced portion thereof; and a ground electrode provided at the tip end of the metallic shell. The center electrode and the ground electrode define a main gap. A projecting inner edge is formed at an open end portion of the metallic shell.

The inner wall surface of the metallic shell extending from the terraced portion toward the tip end of the metallic shell is tapered such that the diameter of the inner wall surface decreases toward the tip end of the metallic shell. Preferably, the amount of tapering of the inner wall surface of the metallic shell is at least 0.6 mm in terms of diameter.

Through employment of this structure, gas volume decreases; accordingly, there is reduced entry into the gas volume of high temperature combustion gas generated in association with combustion of air-fuel mixture within a combustion chamber. Thus, the surface of the insulator is less exposed to high temperature combustion gas. As a result, heat resistance of the insulator is improved. Also, there can be minimized adhesion to and accumulation on the surface of the insulator of carbon generated in association with incomplete combustion of rich mixture. Further, since a certain distance is maintained between the surface of the insulator and the inner wall surface of the metallic shell securing the insulator, the adhesion and accumulation of carbon, if any, does not induce spark leak. Thus, startability of an internal combustion engine is improved, particularly in a cold season.

Further preferably, the inner wall surface of the metallic shell extending from the terraced portion toward the tip end of the metallic shell and reduced in diameter toward the tip end is smoothly tapered with no involvement of a stepped portion.

As described above, through reduction of a gas volume defined by the insulator and the inner wall surface of the metallic shell, there can be minimized entry of high temperature combustion gas into the gas volume during high speed operation as well as entry into the gas volume of combustion gas which contains carbon generated in association with incomplete combustion of rich mixture. Accordingly, a thermal load imposed on the insulator is decreased, and contamination with adhering carbon is prevented, thereby significantly improving heat resistance and contamination resistance and thus widening the range of operation of the spark plug.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Figure 1:
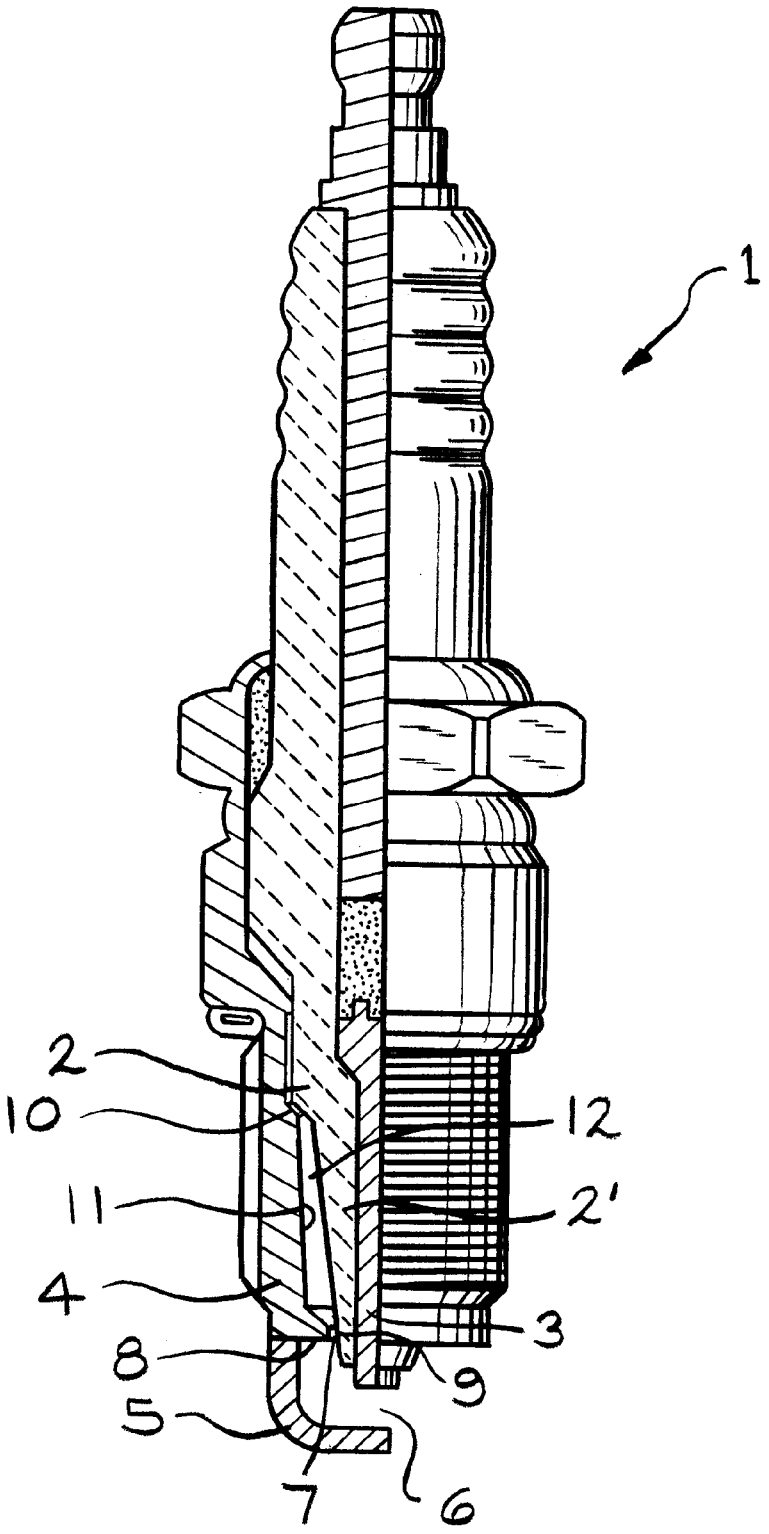
FIG. 1 is a partially sectional view of a spark plug for an internal combustion engine according to a first embodiment of the present invention.
Figure 2A:
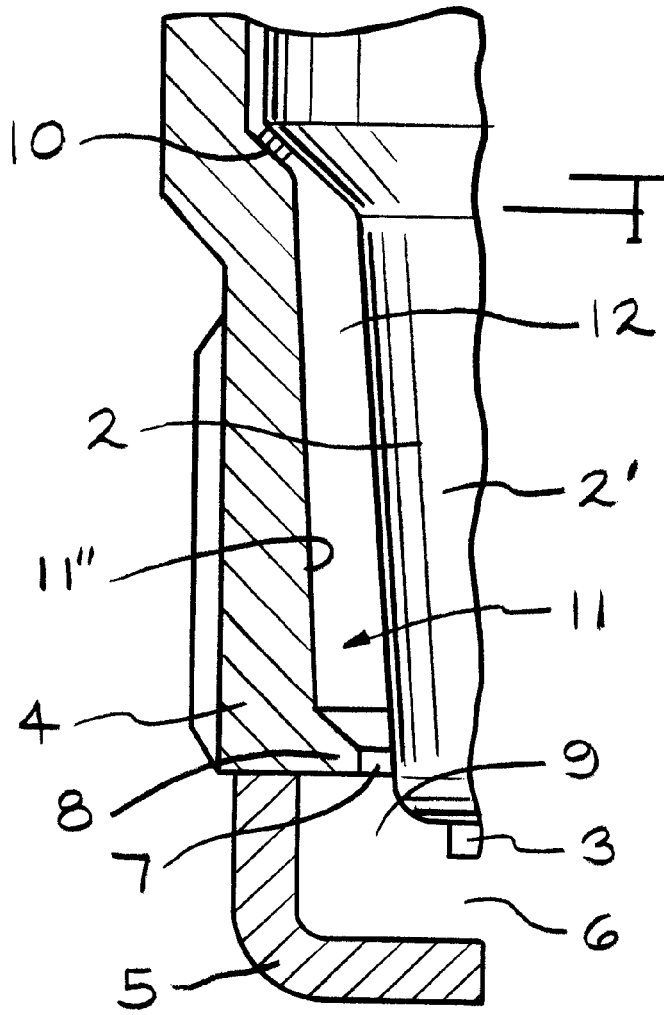
FIGS. 2A and 2B are enlarged sectional views showing a main portion of the spark plug according to the first embodiment.

A first embodiment of the present invention will be described with reference to FIGS. 1 and 2. FIG. 1 shows a partially sectional view of a spark plug 1 of the present invention. FIGS. 2A and 2B show enlarged views of a main portion of the spark plug 1. The spark plug 1 for a stratified charge combustion engine has the following configuration. A center electrode 3 is a composite electrode whose tip end is formed of Cu or Cu alloy having good heat conductivity and is covered with a nickel alloy. The center electrode 3 is held within an insulator 2, which has a leg portion 2' tapering down toward a tip end thereof and which is made of alumina sintered body. The insulator 2 is held by a metallic shell 4 in which a projecting inner edge 8 is circumferentially formed at an open end portion 7 thereof. The projecting inner edge 8 defines an auxiliary gap 9, which will be described later. A ground electrode 5 made of a nickel alloy is attached to the metallic shell 4 by welding or a like method in such a manner as to face the tip end of the center electrode 3, thereby defining a main gap 6 between the center electrode 3 and the ground electrode 5 in which regular spark discharge occurs. When the insulating resistance of the insulator 2 deteriorates due to adhesion of carbon, spark discharge which occurs in the auxiliary gap 9 defined between the center electrode 3 and the projecting inner edge 8 is used to ignite air-fuel mixture in place of spark discharge which occurs in the main gap 6.

An inner wall surface 11"—which is a portion of an inner wall surface 11 of the metallic shell 4 extending from a terraced portion 10 toward a tip end of the metallic shell 4—is smoothly tapered off toward the tip end of the metallic shell 4, i.e., toward the open end portion 7 where the projecting inner edge 8 is circumferentially formed, and in a certain amount substantially similar to the amount of tapering of the leg portion 2' of the insulator 2.

Since the spark plug 1 of the present embodiment employs the above structure, a gas volume 12 defined by the insulator 2, which holds the center electrode 3, and the inner wall surface 11 of the metallic shell 4, which fixedly supports the insulator, becomes smaller than that in the case where the inner wall surface 11 is substantially perpendicular to the open end portion 7. Thus, there can be reduced entry into the gas volume 12 of high temperature combustion gas which is generated in association with combustion of air-fuel mixture within a combustion chamber during high speed operation, so that the surface of the insulator 2' held within the metallic shell 4 is less exposed to high temperature combustion gas. Particularly, a thermal load induced by a thermal cycle and imposed on the leg portion 2' can be decreased, thereby improving heat resistance of the leg portion 2'. Also, there can be minimized adhesion to and accumulation on the surface of the insulator of carbon generated in association with incomplete combustion of rich mixture within the combustion chamber. Further, since a sufficient distance is maintained between the surface of the leg portion 2' of the insulator 2 and the inner wall surface 11 of the metallic shell 4, even when carbon adheres to and accumulates on the insulator surface, deterioration in insulating resistance can be lessened, thereby improving contamination resistance.

Figure 2B:
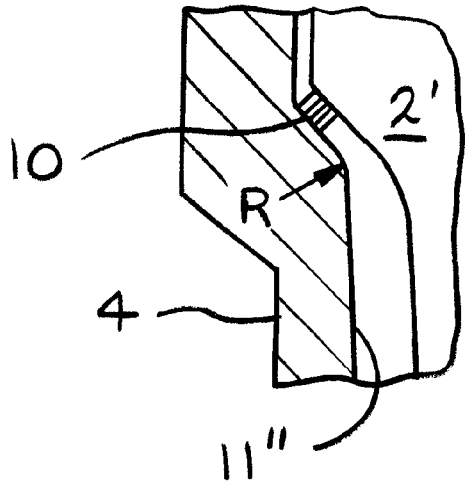

As shown in FIG. 2B, in the spark plug 1, a radius (R) may be imparted to the corner of terraced portion 10 of the metallic shell 4. Through formation of the radius (R), spark leak from the insulator surface to the inner wall surface 10 of the metallic shell 4 less likely occurs, thereby improving contamination resistance.

Figure 3:
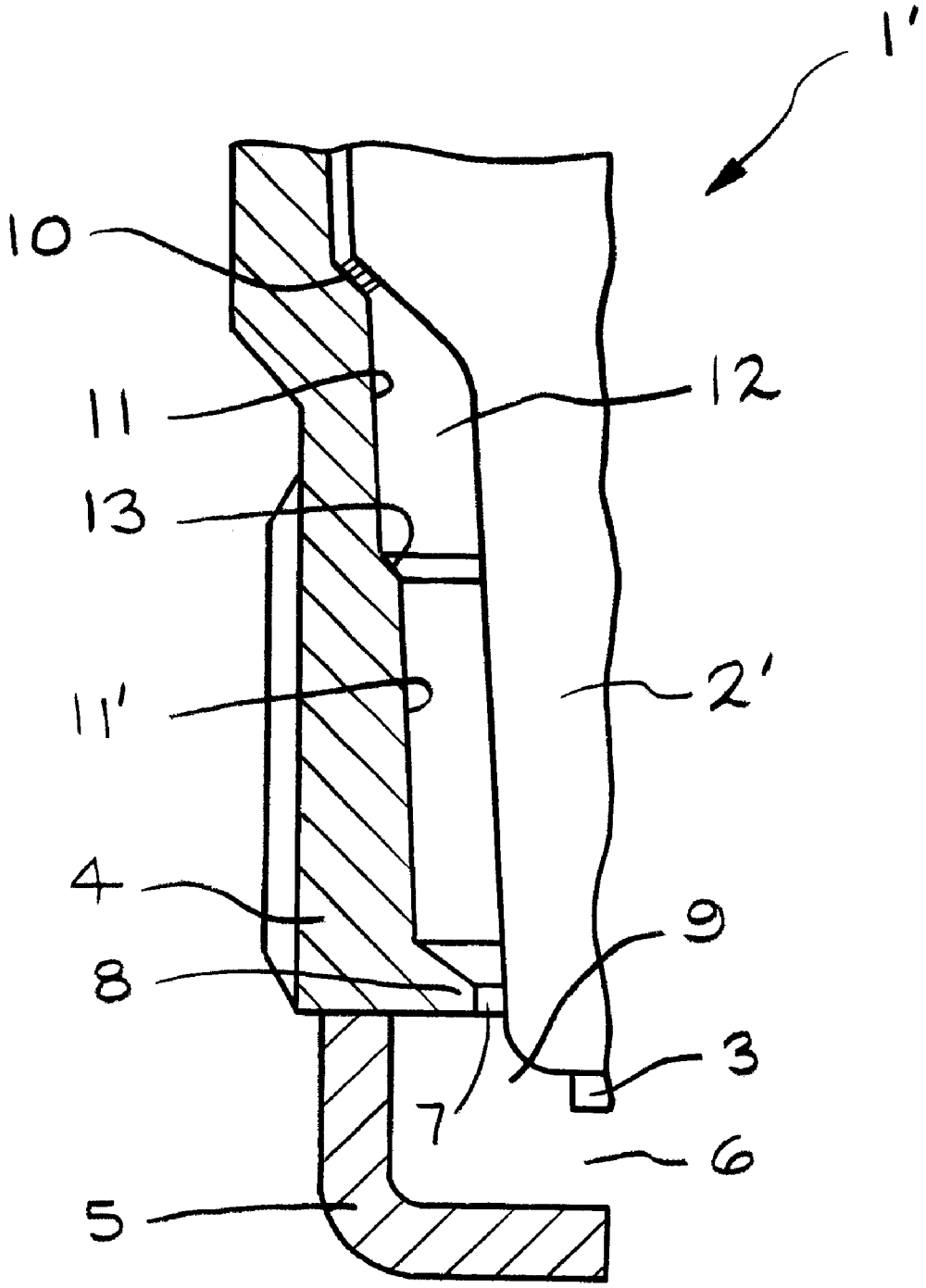
FIG. 3 is an enlarged sectional view showing a main portion of a spark plug for an internal combustion engine according to another embodiment of the present invention.

FIG. 3 shows a spark plug 1' according to another embodiment of the present invention. In the spark plug I', the inner wall surface 11'—which is a portion of the inner wall surface 11 of the metallic shell 4 extending mainly from the terraced portion 10 toward a tip end of the metallic shell 4—is smoothly tapered off toward the tip end of the metallic shell 4, i.e., toward the open end portion 7 where the projecting inner edge 8 is circumferentially formed, and in a certain amount substantially similar to the amount of tapering of the leg portion 2' of the insulator 2. Further, a stepped portion 13 is formed on an inner wall surface 11' of the metallic shell 4 extending downward from the terraced portion 10.

EXAMPLE

The spark plug 1 according to the first embodiment of the present invention was attached to an engine and was tested for contamination resistance and heat resistance. The effect of the invention was verified through comparison of test results with those obtained through use of a conventional spark plug (comparative example) in which the inner wall surface 11 of the metallic shell 4 is perpendicular to the open end portion 7 of the metallic shell 4. A heat resistance test was conducted through use of an 1800 cc, 4-cycle, 4-cylinder, stratified charge combustion engine. Heat resistance was evaluated in terms of the angle of advance at which preignition occurs while ignition timing (BTDC) was varied.

Figure 4:
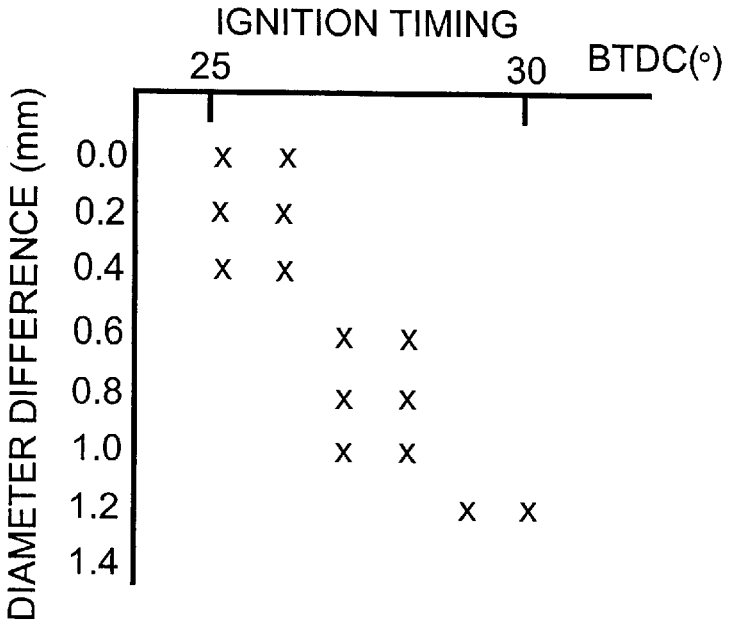
FIG. 4 is a diagram showing the result of a heat resistance test performed on the spark plug according to the first embodiment.
Figure 5:
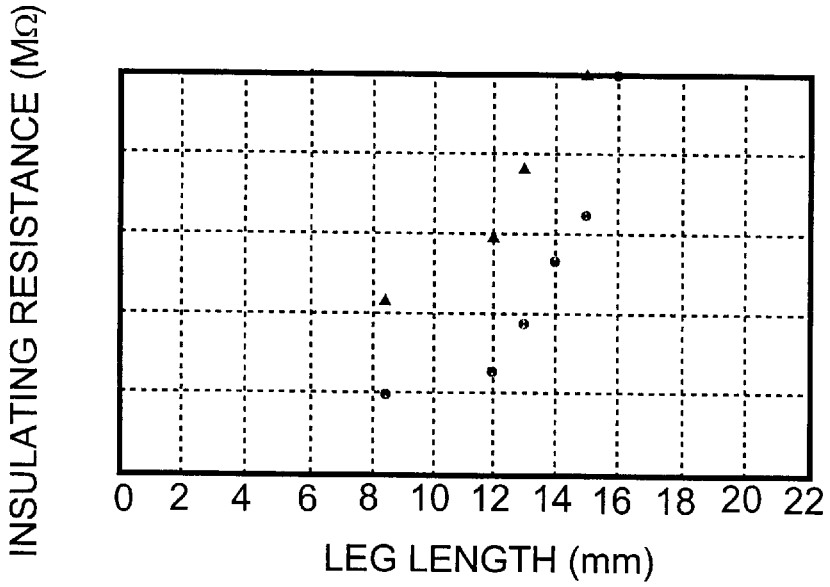
FIG. 5 is a diagram showing the result of a contamination resistance test performed on the spark plug according to the first embodiment.

A contamination resistance test was also conducted through use of the same engine. The contamination resistance was evaluated in terms of an insulating resistance between electrodes as measured after 1-hour idling at a speed of 600 rpm, during which the engine is in a stratified charge combustion state. As seen from the test results, the spark plug 1 for an internal combustion engine exhibits clearly improved heat resistance at an amount of tapering of at least 0.6 mm in terms of diameter of the internal wall surface of the metallic shell (see FIG. 4) as well as marked contamination resistance as compared to the comparative example (see FIG. 5).

Obviously, numerous modifications and variations of the present invention are possible in light of the above teachings. It is therefore to be understood that within the scope of the appended claims, the present invention may be practiced otherwise than as specifically described herein.

What is claimed is:

1. A spark plug comprising, in combination; a tapered insulator having a tip end and a diameter that decreases toward said tip end;

a center electrode held by said insulator;

a metallic shell having a terraced interior portion, an open end and a tip end, said metallic shell fixedly supporting said tapered insulator such that a portion of said tip end of said tapered insulator projects from said metallic shell and said insulator abuts said terraced portion of said metallic shell;

a ground electrode provided at said tip end of said metallic shell, said center electrode and said ground electrode defining a main gap;

an inwardly projecting ledge formed at said open end of said metallic shell; and said metallic shell having a tapered inner wall surface extending from said terraced portion toward said inwardly projecting ledge such that the diameter of said tapered inner wall surface decreases toward said inwardly projecting ledge.

2. The spark plug as described in claim 1 wherein the amount of tapering of said tapered inner wall surface from said terraced portion to said inwardly projecting ledge of said metallic shell is at least 0.6 mm in terms of diameter.

3. The spark plug as described in claim 2 wherein said tapered inner wall surface of said metallic shell extending from the terraced portion toward said inwardly projecting ledge of said metallic shell is smoothly tapered with no stepped portion.

4. The spark plug as described in claim 2 wherein said tapered inner wall surface of said metallic shell extending from the terraced portion toward said inwardly projecting ledge of said metallic shell includes a stepped portion.

5. The spark plug as described in claim 1 further including an auxiliary gap defined between said center electrode and said inwardly projecting ledge of said metallic shell.

6. A spark plug comprising, in combination;

a tapered insulator having a tip end and a diameter that decreases toward said tip end;

a center electrode held by said insulator;

a metallic shell having a terraced interior portion, an open end and a tip end, said metallic shell fixedly supporting said tapered insulator such that a portion of said tip end of said tapered insulator projects from said metallic shall and said insulator abuts said terraced portion of said metallic shell;

a ground electrode provided at said tip end of said metallic shell, said center electrode and said ground electrode defining a main gap;

an inwardly projecting ledge formed at said open end of said metallic shell, said center electrode and said inwardly projecting ledge defining an auxiliary gap; and said metallic shall having a tapered inner wall surface extending from said terraced portion toward said inwardly projecting ledge such that the diameter of said tapered inner wall surface decreases toward said inwardly projecting ledge.

* * * * *